US006431927B1

(12) United States Patent
Sage

(10) Patent No.: US 6,431,927 B1
(45) Date of Patent: Aug. 13, 2002

(54) OUTBOARD PROPELLER DRIVE SYSTEM FOR WATERCRAFT

(76) Inventor: Michael W. Sage, 4251 E. Marin Lakes Dr., Port Clinton, OH (US) 43452

( * ) Notice: Subject to any disclaimer, the term of this patent is extended or adjusted under 35 U.S.C. 154(b) by 0 days.

(21) Appl. No.: 09/815,764

(22) Filed: Mar. 23, 2001

(51) Int. Cl.[7] ..... B63H 5/20
(52) U.S. Cl. ..... 440/53; 440/61
(58) Field of Search ..... 440/53, 55, 57, 440/61

(56) References Cited

U.S. PATENT DOCUMENTS 3,933,116 A 1/1976 Adams et al.
5,066,255 A 11/1991 Sand
5,279,509 A 1/1994 Gifford
5,326,294 A 7/1994 Schoell
5,667,415 A 9/1997 Arneson
5,791,954 A 8/1998 Johnson, Jr.
5,931,710 A 8/1999 Johnson, Sr.

*Primary Examiner*—Jesus D. Sotelo
(74) *Attorney, Agent, or Firm*—Charles F. Schroeder

(57) ABSTRACT

A marine propulsion system mounted on the stern of a boat adaptable to propelling the boat at high speeds through and over water. The depth of operation of the propeller in the water as well as the angle of attack or attitude of the propeller are each adjustable independently of the other, and steering is accomplished by lateral movement of the propeller in a single plane without modifying the depth and attitude of the propeller. In construction the drive shaft assembly is divided into three connected parts, namely the power drive shaft and an intermediated connecting shaft and the propeller shaft. The depth of operation of the propeller and its attitude are adjustable independently of each other by supporting the interconnected shaft assembly from a vertically adjustable overhanging beam structure extending from a vertical support rod at the stern of the boat about which the beam can be moved through an arc to steer the craft.

20 Claims, 5 Drawing Sheets

OUTBOARD PROPELLER DRIVE SYSTEM FOR WATERCRAFT

BACKGROUND OF THE INVENTION

This invention is a marine propeller drive system adaptable to propelling power boats through and over water at high speeds and efficiency, the system being particularly adaptable to propelling high speed planing boats such as catamarans. In propelling a boat forward at high speeds and efficiency it is desirable that its propeller be adjustable in its depth of operation below the water surface as well as with its axis of rotation set at an optimum angle for speed and efficiency.

PRIOR ART

One marine propulsion system representative of the prior art is one in which a propeller at the end of a long drive shaft is lifted or lowered about a pivot at the stern of the boat. The propeller is lifted up or lowered to change its depth but its angle of operation is correspondingly changed limitedly due to the length of the drive shaft. Such a system is disclosed in U.S. Pat. No. 5,791,954, Johnson, Jr., issued Aug. 11, 1998. Another prior art system of propulsion is one in which the propeller shaft is much shorter and the range of angular orientation of the propeller on its axis of rotation is greater but in orienting the propeller its depth of operation is limited by the orientation. Such a system is disclosed in U.S. Pat. No. 3,933,116, Adams, et. al., issued Jan. 20, 1976. In other words, at one side of the spectrum of systems the depth of operation of the propeller determines its angle of operation whereas on the other side of the spectrum the angle of operation determines the depth of operation.

BRIEF DESCRIPTION OF THE PRESENT INVENTION

According to the present invention, the propeller is a marine propulsion system driven by apparatus in which the propeller is adjustable in its depth of operation independently of its angle of operation. This is made possible by supporting the propeller and its propeller shaft and skeg support assembly adjustable about a pivot in an overhanging beam assembly and by providing an intermediate connecting shaft between the engine drive shaft and the propeller shaft. In addition, the level of the overhanging beam assembly with the supporting skeg assembly is vertically adjustable to establish the depth of operation of the propeller below the water level. The details of construction and operation of the assembly will become more apparent upon review of the description of the invention in relation to the drawings accompanying this specification.

A principal object of the present invention is to provide a boat propulsion system in which the angle of the axis of rotation of the propeller and the depth of operation of the propeller can be selected independently of each other and in which the entire assembly can be laterally adjustable to steer the boat.

Another object of the invention is to provide a system of propeller propulsion for a boat to be operated at high speed in which the propeller angle of rotation is adjustable for operation at an ultimate in efficiency.

Still another object of the invention is to provide a boat propulsion system in which the propeller can be operated at any of an infinite number of angles in a given angular range independently of its depth of operation.

Another important and allied objective of the invention is to provide a system in which the propeller operated at a selected angle of operation can be independently raised and lowered to establish an optimum depth of operation.

A principal feature of the invention compared to prior art stem drive systems for water craft is that it allows infinite adjustment of the propeller shaft height and angularity or attitude relative to the running plane of the boat, and additionally that such adjustments can be made while the boat is under way.

Other objects and structural features which are believed to be characteristic of the invention are set forth with particularity in the appended claims. My invention, however, both in organization and manner of construction, together with further objects and features thereof may be best understood by reference to the following description taken in connection with the accompanying drawings.

According to the present invention hereafter described in detail, the system's propeller can be selectively raised and lowered to fix its depth in the water and can be independently adjusted in its angle of orientation to establish an optimum set of propulsion conditions such as for speed and efficiency of operation.

DETAILED DESCRIPTION OF THE INVENTION

Figure 1:
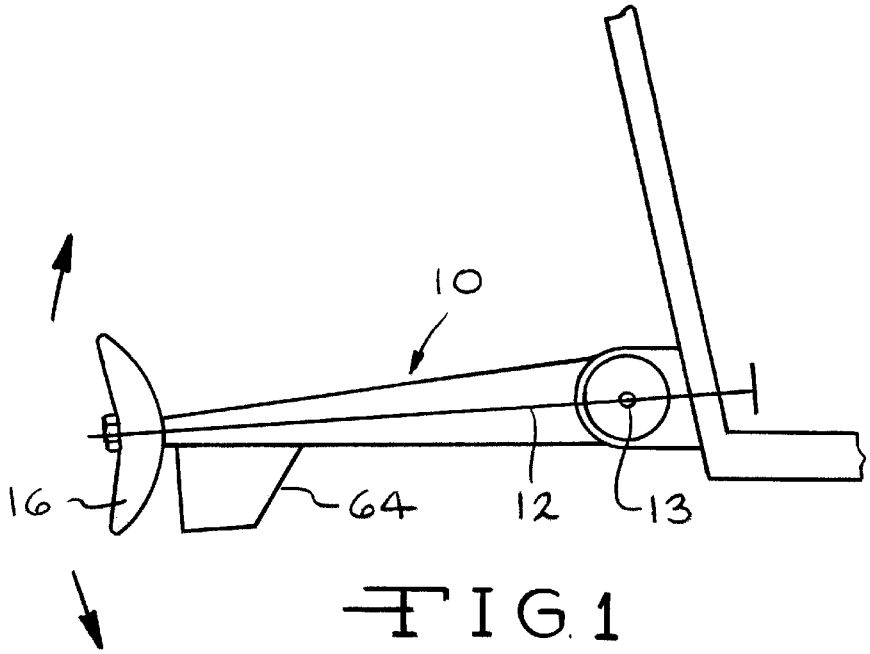
FIG. 1 PRIOR ART
FIG. 1 is an illustration of a prior art system for direct drive of a propeller with a long shaft in which the angle of the propeller is changed limitedly by lifting or lowering the propeller drive shaft about a pivot point at the stem of a boat.

FIG. 1 illustrates a prior art stem drive propulsion system 10 which shows how a propeller 16 and its drive shaft 12 can be raised and lowered about a pivot point 13 to change the orientation of the propeller relative to the water surface and the boat bottom while a skeg 64 of the drive is maintained in the water. The range of angular change of the propeller in such instance is quite limited dependent upon the drive shaft orientation to fix both the depth of the propeller and to maintain the skeg 64 in the water for steering.

Figure 2:
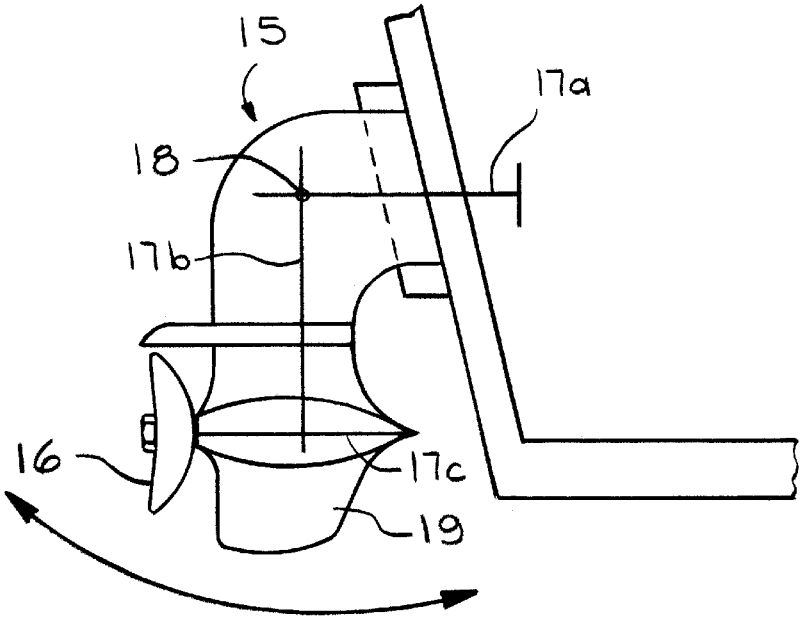
FIG. 2 PRIOR ART
FIG. 2 is an illustration of a prior art propeller drive system mounted at the stem of a boat in which the propeller angle is changed by moving the propeller and its drive shaft system in pendulum-like fashion about an upper pivot point at the stern of the boat.

FIG. 2 illustrates another prior art stem drive system 15 in which the propeller 16 is driven by an articulated assembly of drive shafts 17*a*, 17*b*, and 17*c*. The horizontal drive shaft 17*a* is connected to the propeller shaft 17*c* by a connecting shaft 17*b*. To trim the propeller 16, or in other words, change its driving orientation, the assembly must be swung in pendulum fashion about the pivot point 18 which causes the propeller to be lifted or lowered in the water. When lifted too far, both the propeller and the skeg 19 can become exposed above water. In this arrangement the depth of the propeller and its orientation are also not adapted to being independently adjusted.

Figure 3:
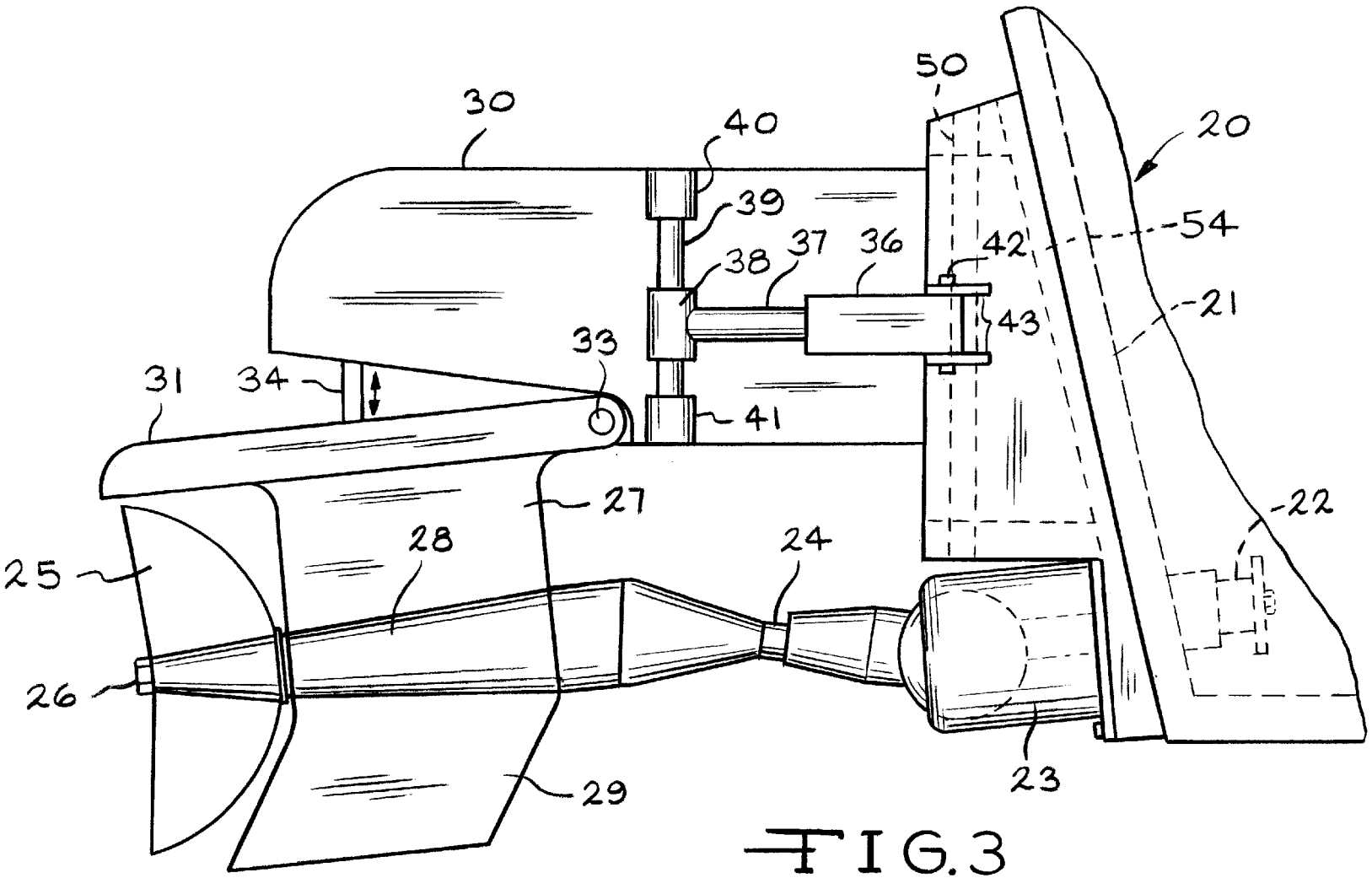
FIG. 3 is a side elevational view of a propulsion system constructed according to the concept for the present invention in which the system is driven by an inboard engine (not shown) with the assembly extending stemwise of the boat illustrating the propeller being oriented slightly downwardly from horizontal.

FIG. 3 in contrast is an illustration of the overall assembly of components incorporated in the presented propulsion system in which the propeller attitude is adjustable independently of its depth adjustment. The system is mounted on the stern 20 of the boat, shown in broke away view with its transom 21 and a drive shaft connection 22 illustrated in dotted lines. A power supply shaft (not shown) extends from the connection 22 to a joint housing 23 through which it connects to an intermediate connecting shaft 24 shown in greater detail hereinafter. The intermediate shaft 24 connects with the propeller shaft (not shown) which extends through the propeller shaft thrust housing 28 to drive the propeller 25 secured to the end of the propeller shaft by a lock-nut 26. A skeg 29 provided to assist in steering the craft extends below the propeller shaft thrust housing 28. The propeller shaft and its thrust housing 28 are supported by a shaft housing support 27 attached to a prop wash shield 31 which is pivotally mounted on a horizontally aligned pivot pin 33 which in turn is mounted on the housing of an over-beam assembly 30 mounted at the stem 20 in cantilevered relation over the interconnected shaft 24 and the propeller shaft trust housing 28. The propeller shaft extending through the propeller thrust housing 28 and the propeller 25 are thus capable of being angularly trimmed by selectively lowering and raising the prop wash shield 31 about its pivot support pin 33. The pivotal movement of the prop wash shield is effected by actuating and controlling an interiorly mounted piston having a piston rod 34 extending therefrom and connected to the prop wash shield 31.

The steering of the boat is effected by moving the over-beam assembly 30 laterally about a vertically mounted pivot steering rod 50 (shown in dashed lines) enclosed in the housing secured to the transom 21 of the boat. The over-beam assembly 30 is laterally moveable in either direction about the steering rod 50 by a pair of identical pistons 36 and 36*a* (FIG. 6) swingably mounted on opposite sides of the over-beam assembly 30. Each piston is mounted at a fixed vertical level on hinge pins 42 and 42*a,* which in turn are secured in a pair of spaced piston mounts 43 and 43*a,* above and below the end of each piston and arranged to permit the piston to move in an arc along side the over-beam assembly with which it is associated. The pistons 36 and 36*a* have associated piston rods 37 and 37*a* respectively extending to steering pins 39 and 39*a* respectively fixedly mounted between two spaced pin mounts 40 and 40*a* respectively in the upper region of the over-beam assembly and lower pin mount 41 both projecting from the side of the over-beam assembly. The piston rods 37 and 37*a* each have at their ends a connection 38 which is vertically slideable on the steering pin 39 so that as the over-beam assembly is moved up or down along the steering rod 50, as hereinafter described, a corresponding lifting and lowering sliding adjustment of the piston rod 37 and its sliding connection 38 occurs on its steering pin 39. This can be seen by reference to FIG. 4 wherein the over-beam assembly 30 has been lowered a bit in contract to its position shown in FIG. 3.

As indicated, to steer the boat the over-beam assembly is moved to one side or the other about the steering rod 50, for example, by extending a piston rod 37 on one side of the over-beam assembly and retracting the piston rod 37 on the opposite side of the over-beam assembly. Such steering movement is accomplished without changing the depth or angle of orientation of the propeller 25. In other words the propeller can be swung in a horizontal plane through the water without changing its attitude or the orientation of its drive shaft.

Figure 4:
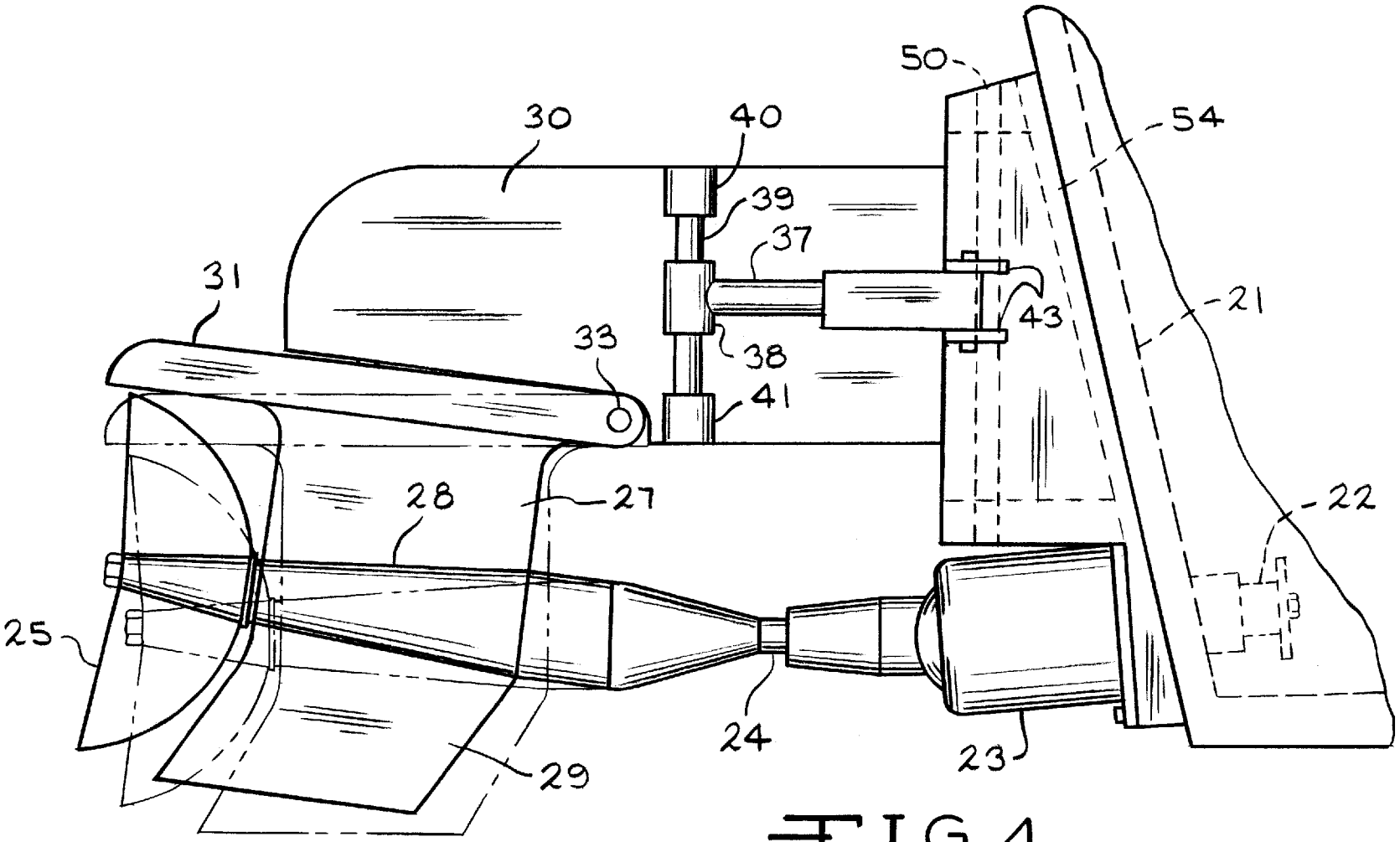
FIG. 4 is a side elevational view corresponding to that of FIG. 3 in which the propeller is illustrated oriented in an upward direction.

FIG. 4, shows the over-beam assembly 30 lowered slightly relative to its showing in FIG. 3 and a change in orientation of the propeller 25 illustrated by showing the prop wash shield 31 drawn upwardly about its pivot pin 33 and having been drawn upwardly to its limit where its lift rod 34 no longer shows. This lifting causes both the propeller 25 and its propeller shaft interior of the prop thrust housing 28 also drawn upwardly to the limit of its angular range.

As the propeller is thus lifted in its angular orientation, the over-beam assembly can be correspondingly lowered to lower the propeller to a depth desired below the surface of the water. An infinite number of angles of orientation of the propeller and its propeller shaft can thus be selected within the range for which it is designed. Correspondingly, the depth to which it is to operate can be selected by lifting or lowering the over-beam assembly 30 to any of a number of depth settings within the range for which the system is designed. In both cases of adjustment, either for orientation of operation of the propeller or the depth of operation of the propeller the range of selection can be quite wide to attain the most effective settings for the propulsion system of the boat on which it is mounted.

Figure 5:
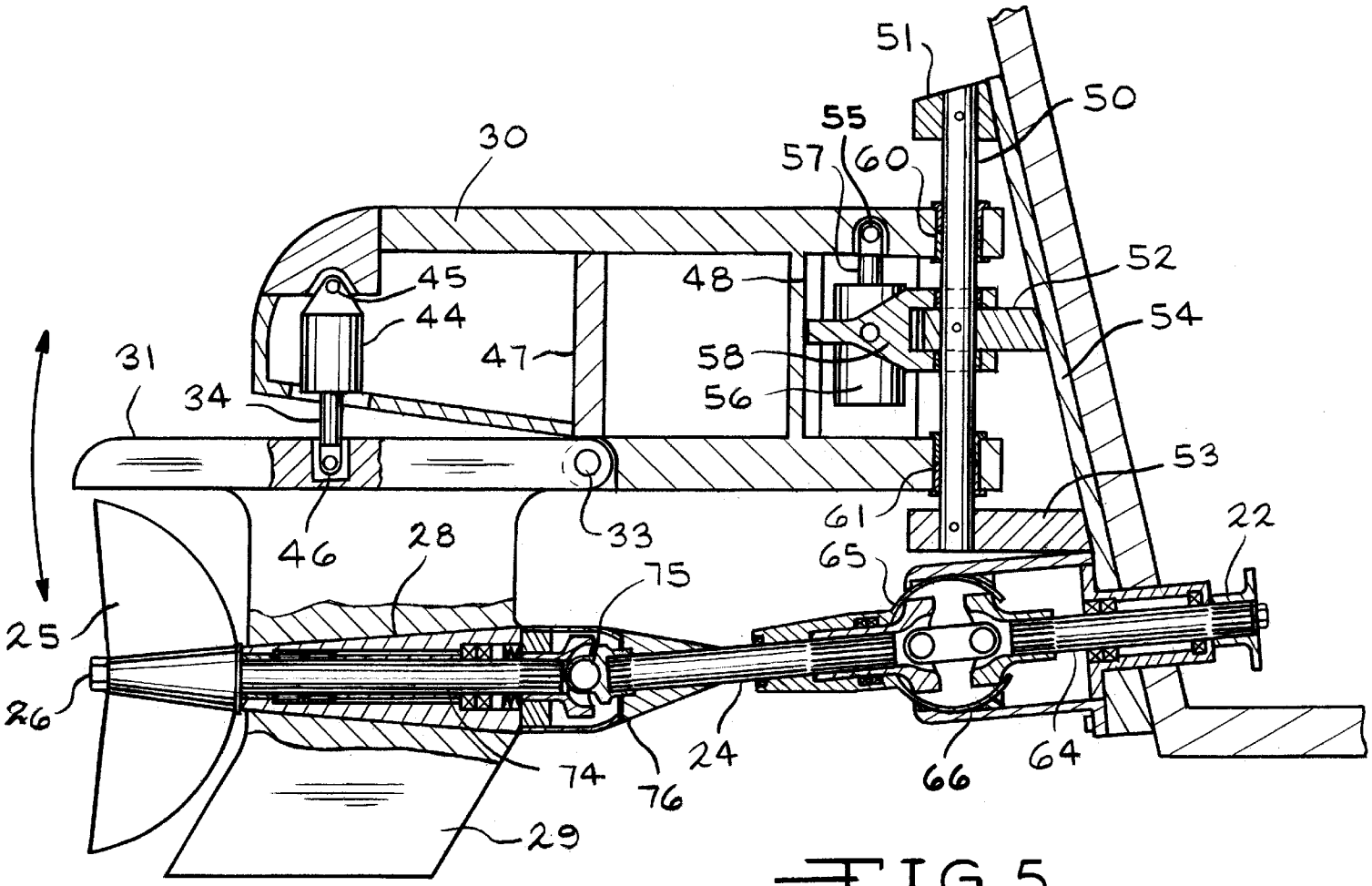
FIG. 5 is view of the propulsion assembly of FIGS. 1 and 2 illustrated mainly in a cross section and broken away view to show the interassociation of parts which makes the novel functional aspects of the invention possible.

FIG. 5 illustrates in cut away section both the interior of the over-beam assembly 30 and the assembly of the power supply drive shaft 64 extending from the connection 22 to a double universal joint assembly 65 within a sealed housing 66. The intermediate shaft 24 is connected by way of the joint 65 to the power drive shaft 64 and its other end is connected to a single universal joint 75 joined within a joint housing 76 to the prop propeller shaft 74. Rotational power is thus transmitted by way of the power drive shaft 64 through the universal joint 65 to the propeller shaft 74 and to the propeller 25 by way of the intermediate shaft 24. The joint 65 is preferably one such as a double yoke universal joint which permits a wide lateral swing of the propeller shaft and intermediate shaft during steering upon lateral movement of the over-beam assembly 30. The joint assembly 65 is mounted in alignment under the end of the steering rod 50, in line with the axis of rotation of the rod 50 to provide the same axis of rotation for the lateral movement of the propeller shaft 74 as that of the over-beam 30 during steering of the water craft.

The universal joint 65 also provides a horizontal axis for rotation for the combination of the intermediate connecting shaft 24 and the propeller shaft 74. In addition the universal joint 75 connected to the end of the intermediate shaft 24 and joining to the propeller shaft 74 provides a range of vertical angular movements of the propeller shaft 74 to set the axis of rotation of the propeller 25. The angle is changed by drawing the piston rod 34 upwardly or pushing it downwardly from a piston 44 pivotally mounted at a support pin 45 on the over-beam. Correspondingly the end of the piston rod 34 is pivotally secured to the over-beam assembly 30 at a pivotal connecting pin 46 thereby allowing self adjustment of the piston 44 and the piston rod 34 as angular changes of the propeller and its propeller shaft 74 occur when angular settings of the propeller are made upon the propeller shield 31 being lifted and lowered by the piston 44 and piston rod 34 about the pivot pin 33.

The over-beam assembly 30 is lifted and lowered selectively by a piston 56 and its piston rod 57 extending therefrom connected at a connecting pin 55 to which the end of the piston rod 57 is secured. The piston 56 is mounted at a fixed level by securement to a laterally moveable swivel fork 58 which has projections extending over and under an intermediate fixed mount 52 projecting from a stern mounting plate 54. The swivel fork 58 is arranged to have the steering rod 50 extend therethrough to permit it to be swung with the over-beam assembly 30 as it is moved laterally during steering of the water craft.

The steering rod 50 is fixed in its vertical position between an upper fixed mount 51 and a lower fixed mount 53, both projecting rearwardly from the stem mounting plate 54. The over-beam assembly 30 is mounted on the steering rod 50 by way of an upper sliding bushing 60 and a lower sliding bushing 61 incorporated in the upper and lower walls of the over-beam assembly. The over-beam assembly is provided with internal bracing such as vertical bracings 47 and 48 representative of these and other bracings which can be provided to impart a rigidity to the assembly. Thus the over-beam assembly 30 can be moved up and down by the piston 56 fixedly secured to the intermediate mount 52 projecting from the stem mounting plate 54. This results in a corresponding lifting and lowering of the propeller shaft housing 28 without changing the attitude of the rotation of the propeller 25. To change the attitude or angle of the axis of rotation of the propeller 25, the prop wash shield 31 is lifted or lowered about its pivot pin 33 which angular adjustment can be made independently of the lifting and lowering of the over-beam assembly.

Figure 6:
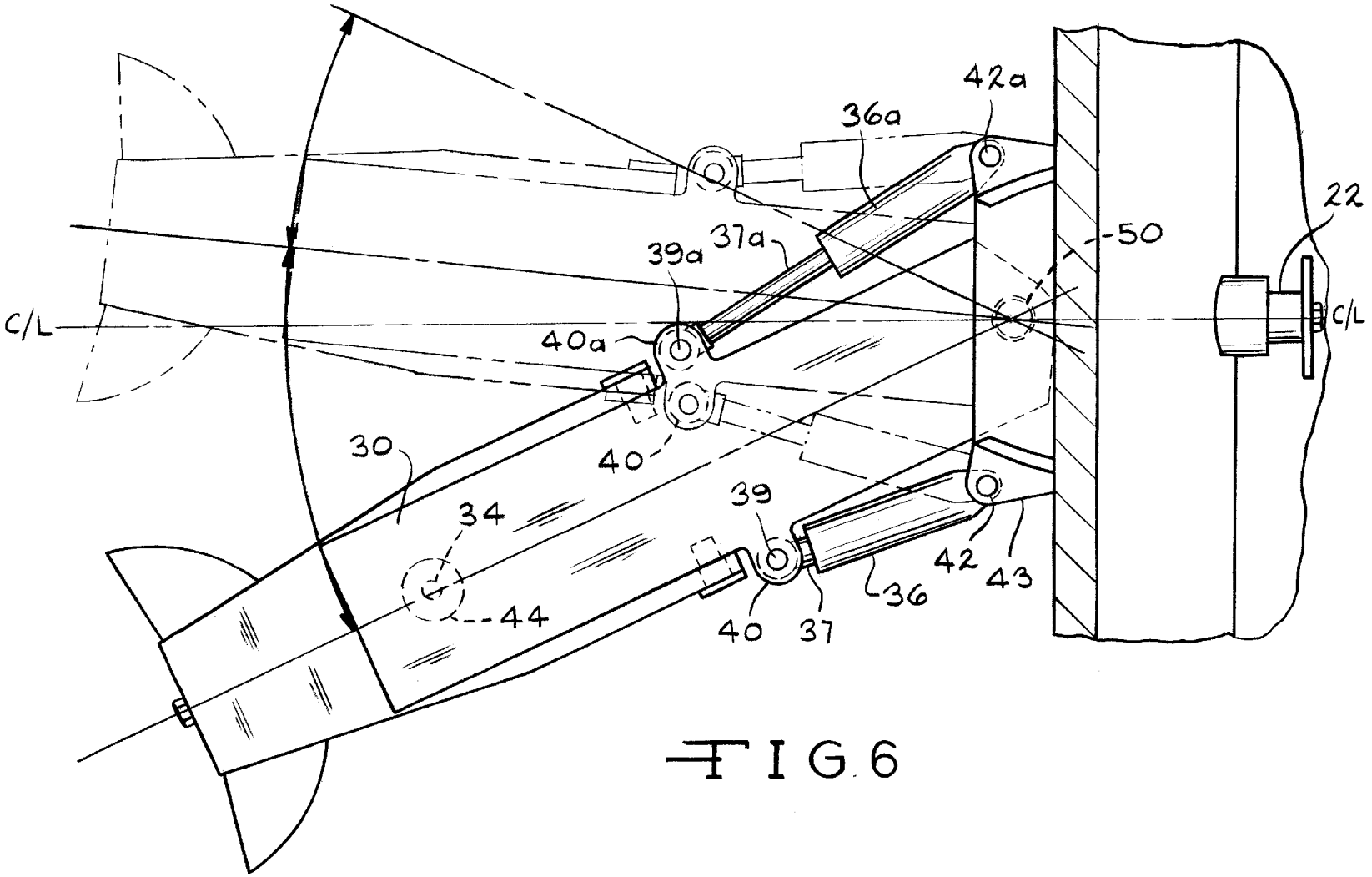
FIG. 6 is a top plan view of the assembly of FIGS. 3–5 illustrating in solid and dashed lines how the propulsion assembly can be moved at a lateral angle from one side to the other to steer the boat on which it is mounted.

The manner in which the boat can be steered is illustrated in FIG. 6 wherein the over-beam assembly is swung about the steering rod 50 under the force of the steering pistons 36 and 36*a* on opposite sides of the over-beam. The steering pistons 36 and 36*a* are mounted between piston mounts 43 and 43*a* and secured by hinge pins 42 and 42*a* respectively. Their respective piston rods 37 and 37*a* extend to fastening projections 40 and 40*a* projecting laterally from the over-beam assembly 30. The piston rods 37 and 37*a* are secured to the projections 42 and 42*a* by hinge pins 39 and 39*a* respectively. The over-beam assembly is swung about the steering pin 39 under the force of the steering pins 36 and 36*a* by having the force of one steering piston rod causing the over-beam assembly to be pushed to one side of the boat transom while the steering piston rod on the other side of the boat is retracted within the piston. The hinge support at both ends of each piston and its respective rod allows each piston and rod assembly to be swung about its hinge pins at both ends of each piston and rod assembly.

FIG. 6 also illustrates how the over-beam assembly 30 can be swung both in the starboard and port directions to place propeller 25 in a position to steer the boat. The lift rod 34 extending from the piston 44 is positionable to raise and lower the propeller axis of rotation within its design range. The propeller shaft 74 is oriented with its housing 28 about the universal joint 75 by lifting of the propeller wash shield 31 about its pivot pin 33. The universal joint 75 is located directly under the horizontal pivot pin 33 so the propeller shaft 28 moves through an angle about the joint 75 corresponding to that through which the propeller wash shield 31 moves about its pivot point 33.

The double universal joint 65 located between the power drive shaft 64 and the intermediate connecting shaft 24 is located directly under and in alignment with the axis of the steering rod 50 which allows the axis of the propeller shaft 74 to be swung laterally over the angular range matched to the movement of the over-beam assembly 30. The intermediate shaft 24 which in effect connects the drive shaft 64 and the propeller shaft 74, because of its being connected between the double universal joint 65 and the second universal joint 75, can accommodate the lateral movement of the propeller shaft 74 about the joint 65 as well as the vertical angular movement of the end of the propeller shaft 28 about the joint 75 and its overlying pivot pin 33 for the shield 31.

The rotational power from the inboard motor is transmitted directly to the drive shaft 64 through its connection 22 and into the universal joint 65, a ball and socket assembly. As indicated the joint 65 is in the form of an H-type double yoke universal assembly, such as a double Cardan universal joint, which allows a wider than usual range of angular movement of the over-beam assembly during steering. By way of example, the lateral angular movement of the over-beam and the underlying intermediate connecting shaft 24 about the universal joint 65 can be in the order of plus or minus 24 degrees.

The power for lifting and for lateral movement of the over-beam assembly can be supplied preferably by hydraulic means but alternately can be pneumatic or electrical.

This direct drive to propeller shaft design eliminates the need for gear sets with their corresponding power loss, thereby increasing reliability of the present system. The fact that the steering is done by turning the propeller laterally eliminates the need for a separate rudder for the boat which eliminates some loss by friction at high speeds. In practice not only one, but two of three of the described propulsion systems can be operated together in unison at the stern of a boat for speed as well as for steering of the craft. Also, with the lack of gearing, less maintenance is entailed in operating the system.

In view of the foregoing it will be understood that many variations of the arrangement of the invention can be provided within the broad scope of principles embodied therein. Thus, while a particular preferred embodiment of the invention has been shown and described, it is intended by the appended claims to cover all such modifications which fall within the true spirit and scope of the invention.

What is claimed is:

1. A watercraft propulsion system for propelling a boat such as a high speed planing boat through and over water in which the boat has an inboard engine and a connecting power supply drive shaft extending through the transom of the boat to an outboard end comprising, a propeller shaft extending rearwardly of said boat having a propeller secured to its rearward end, an intermediate connecting shaft connected at one end to said outboard end of said drive shaft and at its other end to the forward end of said propeller shaft, the connections at said outboard end of said drive shaft and said other end of said connecting shaft being universal joint connections, an over-beam assembly extending from a support means at the stem of said boat over the exterior portion of said drive shaft as well as said intermediate shaft and said propeller shaft, said support means for said over-beam assembly comprising a vertically oriented support rod fixedly mounted to the stem of said boat, said propeller shaft extending through a support housing therefore connected to said overlying over-beam assembly, said support means for said over-beam assembly being arranged to permit lateral movement of the end of said over-beam assembly to either side of said boat with said vertically oriented support rod as a pivot therefore, whereby said boat can be steered by selectively positioning said over-beam assembly to one side or the other side with resulting corresponding lateral angular movement of said propeller shaft and the propeller thereon.

2. A boat propulsion system as set forth in claim 1 in which the universal joint connection between said drive shaft and said intermediate shaft is positioned in axial alignment with and directly below the end of said support rod.

3. A boat propulsion system as set forth in claim 2 in which said universal joint between said drive shaft and said intermediate shaft is a double joint designed to permit a wide angle movement of said intermediate shaft to facilitate steering of the boat in tight circles.

4. A boat propulsion system as set forth in claim 3 in which said support means for said over-beam assembly is arranged to permit selective raising and lowering of said over-beam assembly to establish a desired depth of operation of said propeller in water.

5. A boat propulsion system as set forth in claim 4 in which said connection to said over-beam assembly is a pivotal connection in alignment directly above the universal joint between said propeller shaft and said intermediate connecting shaft whereby said propeller shaft and propeller can be vertically angularly oriented about said pivotal connection for selection of efficiency of operation of said propeller.

6. Boat propulsion apparatus in which the apparatus is mounted on the stem of a boat for driving power supplied by an inboard motor having a connecting power supply drive shaft extending out through the stern of the boat, said apparatus comprising a propeller shaft extending rearwardly from said stern having a propeller secured at the rear end thereof, an intermediate connecting shaft coupled at one end to said drive shaft and at its other end being coupled to said propeller shaft, an over-beam assembly extending from the stem of the boat in overhanging relation with said drive shaft and said intermediate shaft and said propeller shaft, a support structure for said propeller shaft through which said propeller shaft passes and which is secured to said over-beam assembly, a support rod for said over-beam assembly mounted on the stem of said boat in vertically oriented relation to the bottom of said boat, said over-beam assembly being arranged to be vertically movable both upwardly and downwardly on said support rod, said propeller shaft and its said support structure both being adjustably moveable both upwardly and downwardly with its support structure in its secured relation with said over-beam assembly.

7. The propulsion apparatus as set forth in claim 6 in which said support structure for said propeller shaft is secured to said over-beam assembly at a pivot on said over-beam assembly in pivoted relationship therewith, whereby said propeller shaft can be tilted to raise and lower the propeller about said pivot to a desired depth.

8. A boat propulsion system as set forth in claim 7 in which a universal joint connection is provided between said intermediate shaft and said propeller shaft aligned vertically directly under said pivot.

9. A propulsion system for boats as set forth in claim 8 which said over-beam assembly can be swung horizontally about said support rod in an arc extending laterally at the rear of said stem to both sides of said boat to correspondingly move said propeller to steer said boat.

10. A propulsion system for a boat as set forth in claim 9 in which a universal joint connection is provided between said intermediate shaft and said drive shaft aligned directly below the end of said vertically oriented support rod, whereby said propeller shaft and intermediate shaft will move laterally under and with said over-beam assembly in matched relation thereto.

11. A propulsion system for a boat as set forth in claim 10 in which the said universal joint connection between said drive shaft and said intermediate shaft is a double universal joint to permit a wider lateral angular movement of said intermediate shaft about the end of said drive shaft.

12. Propulsion apparatus for a boat in which the apparatus is mounted on the stem of the boat to be powered by an inboard motor having a power supply shaft for connection to a motor extending out through the stem of the boat to an exterior power supply end, said apparatus comprising a rearwardly extending intermediate connecting shaft connected at one end to said power supply end of said power supply shaft and at its other end to a propeller shaft extending rearwardly therefrom, a propeller mounted on the rearward end of said propeller shaft, an over-beam assembly mounted at the stem of said boat in cantilevered relation over said connection shaft and said propeller shaft, a support housing for said propeller shaft through which said propeller shaft passes, said support housing being secured to said over-beam assembly, a vertically oriented pivot rod for support of said over-beam assembly mounted at the stem of said boat, said over-beam assembly being mounted on said pivot rod so that its end extending over said propeller shaft can be moved laterally about said pivot rod, said connection between said end of said power supply shaft and said intermediate connecting shaft being a universal joint connection aligned under the end of said vertical pivot rod, said universal joint connection permitting lateral movement of said connecting shaft and said propeller shaft in unison with the over-beam assembly, means for selective lateral positioning of said over-beam assembly about said pivot rod to position said propeller in steering said boat.

13. Boat propulsion apparatus as set forth in claim 12 in which said universal joint connection is a double yoke universal connection adapted to provide a wide lateral movement of said connecting shaft about said end of said power supply shaft to facilitate steering of the boat in tight circles.

14. Boat propulsion apparatus set forth in claim 12 in which said over-beam assembly is arranged to be selectively raised and lowered on said pivot rod to permit establishment of a desired depth of operation of said propeller in water.

15. Boat propulsion apparatus as set forth in claim 14 in which said support housing for said propeller shaft is pivotally secured to said over-beam assembly at a pivot connection in such manner as to permit said propeller shaft and said propeller to be raised and lowered to fix a desired angle for the axis of rotation of said propeller.

16. Boat propulsion apparatus as set forth in claim 15, in which the connection between said intermediate connecting shaft and said propeller shaft is a universal joint aligned under said pivot connection of said support housing to said over-beam assembly.

17. Boat propulsion apparatus as set forth in claim 14 in which said over-beam assembly is raised and lowered by the force of a piston mounted in a fixed position at said stem.

18. Boat propulsion apparatus as set forth in claim 17 in which said piston is mounted within said over-beam assembly in a swivel fork permitting said piston to move about said pivot rod with said over-beam assembly.

19. Boat propulsion apparatus as set forth in claim 12 in which said over-beam assembly is moved laterally under force of at least one piston connected thereto.

20. Boat propulsion apparatus as set forth in claim 19 in which said over-beam assembly is moved by pistons positioned on opposite sides of said over-beam assembly.

* * * * *